United States Patent [19]

Sheu

[11] Patent Number: 4,997,301

[45] Date of Patent: Mar. 5, 1991

[54] FOUNTAIN PEN

[76] Inventor: Jyug-Jen Sheu, Fl. 11-7, No. 3, Fu-Hsing-Erh Rd., Ling-Ya Dist., Kaohsiung City, Taiwan

[21] Appl. No.: 486,892

[22] Filed: Feb. 28, 1990

[51] Int. Cl.[5] ..... B43K 5/04; B43K 5/18

[52] U.S. Cl. ..... 401/146; 401/156

[58] Field of Search ..... 401/132, 133, 134, 135, 401/155, 152, 156, 169, 143, 146, 149, 150, 145

[56] References Cited

U.S. PATENT DOCUMENTS

| | | | |
|---|---|---|---|
| 1,155,611 | 10/1915 | Pierce | 401/101 |
| 1,811,992 | 6/1931 | Bell | 401/133 |
| 2,536,923 | 1/1951 | Fehling | 401/156 X |
| 3,351,074 | 11/1967 | Aston | 401/135 |

*Primary Examiner*—Richard J. Johnson

*Attorney, Agent, or Firm*—Arnold, White & Durkee

[57] ABSTRACT

A fountain pen includes a fountain pen barrel, an ink tube fixed inside the pen barrel, a stopper means fixed inside said pen barrel to hold the ink tube in place, and a fountain pen head joined to the other end. A pressing force applied to an urging means moves the ink tube in an axial direction towards a writing core which guides ink from the ink tube in a capillary flow. Axial movement enables the stopper means to generate a contracting force on the ink tube to increase the releasing pressure of the ink. Excess ink absorbed by the writing core permeates an ink absorbent member disposed inside the fountain pen head to prevent leakage of excess ink.

7 Claims, 2 Drawing Sheets

FOUNTAIN PEN

BACKGROUND OF THE INVENTION

This invention relates to a fountain pen, more particularly to a fountain pen wherein ink is released to the writing core by applying pressure.

FIG. 1 shows a sectional view of an ordinary fountain pen which comprises a hollow pen barrel 10 with a cotton sponge member 20 disposed inside the hollow space. A fountain pen head 30 is attached to the lower end of the pen barrel 10. A writing core 31, which is axially disposed inside the fountain pen head 30, has one end projecting out of the fountain pen head 30 and another end in contact with the cotton sponge member 20. Ink is filled at the top end of the pen barrel 10 and absorbed by the cotton sponge member 20. A cover 11 seals the top end of the pen barrel 10. The writing core 31 absorbs the ink from the cotton sponge member 20 and transfers it to a writing surface when the fountain pen is used.

The main drawbacks of this fountain pen are as follows;

1. If too much ink is absorbed by the writing core 31, ink may leak onto the writing surface or to a fountain pen cover, the former resulting in blotting.
2. A large portion of the cotton sponge member 20 is exposed to air, causing evaporation of the ink. This means less efficiency in terms of ink usage.
3. The size of the cotton sponge member is relatively large. This makes it difficult to see if the ink poured during the ink replenishing process is adequate. Furthermore, the ink replenishing procedure takes up a lot of valuable time.

SUMMARY OF THE INVENTION

Therefore, the object of this invention is to provide a fountain pen which has provisions for minimizing blotting, maximizes ink usage and has provisions for easy replenishment of ink.

Accordingly, a fountain pen of this invention comprises a fountain pen barrel, a replaceable ink tube fixed inside the pen barrel, a stopper means which holds the ink tube in place, and a fountain pen head having a writing core which receives ink from the ink tube. An urging means moves the ink tube in an axial direction towards the fountain pen head whenever a pressing force is applied on it. The axial movement enables the stopper means to generate a contracting force on the ink tube to increase the releasing pressure of the ink inside the ink tube. Excess ink absorbed by the writing core permeates an ink absorbent member disposed inside the fountain pen head.

BRIEF DESCRIPTION OF THE DRAWINGS

Other features and advantages of this invention will become apparent in the following detailed description of the preferred embodiment with reference to the accompanying drawings, in which.

DETAILED DESCRIPTION OF THE PREFERRED EMBODIMENTS

Figure 1:
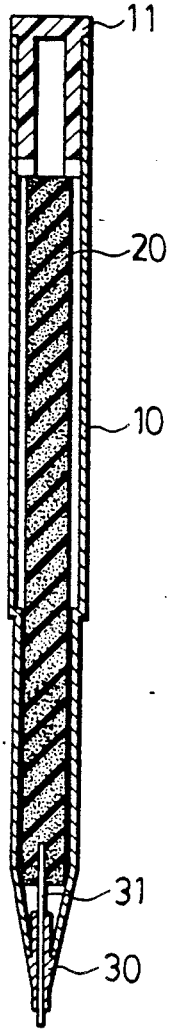
(PRIOR ART) FIG. 1
FIG. 1 is a sectional view of prior art.
Figure 2:
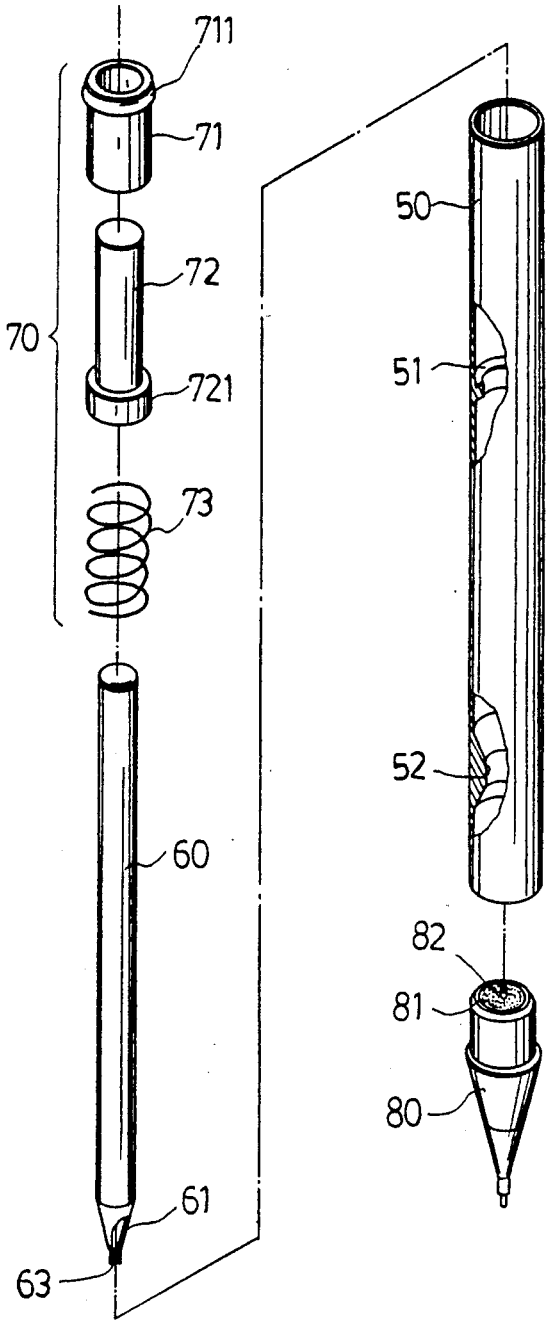
FIG. 2 is an exploded view of a fountain pen according to this invention.

Referring to FIG. 2, an exploded view of a preferred embodiment of a fountain pen according to this invention comprises a fountain pen barrel 50, an ink tube 60, urging means 70 and a fountain pen head 80.

The fountain pen barrel 50 is formed as a hollow body with two open ends. An inwardly projecting annular ring 51 protrudes near the first open end of the pen barrel 50. The ink tube 60, made of a flexible material, is received inside the hollow space of the fountain pen barrel 50. An open end 61 of the ink tube 60 is substantially converging and has an ink outlet hole 63 to serve as an outlet for ink 62 contained in the tube. The open end 61 of the ink tube 60 is in contact with a stopper means 52, which is shaped as a substantially trapezoidal endless projection and inwardly projects near the second open end of the pen barrel 50.

The urging means 70 is received by the first open end of the fountain pen barrel 50 and effectively seals the same. The urging means 70 comprises a wall casing 71, a pressure post 72, and a biasing means 73. The wall casing 71 has an annular ring shoulder 711 formed on a first end. The pressure post 72 comprises a hollow circular base 721. The wall casing 71 is sleeved over the pressure post 72.

The fountain pen head 80 is substantially funnel-shaped and is joined to the second open end of the fountain pen barrel 50, effectively sealing the same. An ink absorbent member 81 is disposed inside the fountain pen head 80. A pith-like writing core 82, formed as a slender pole, is disposed inside the ink absorbent member 81 and has two ends that project out of the fountain pen head 80.

Figure 3:
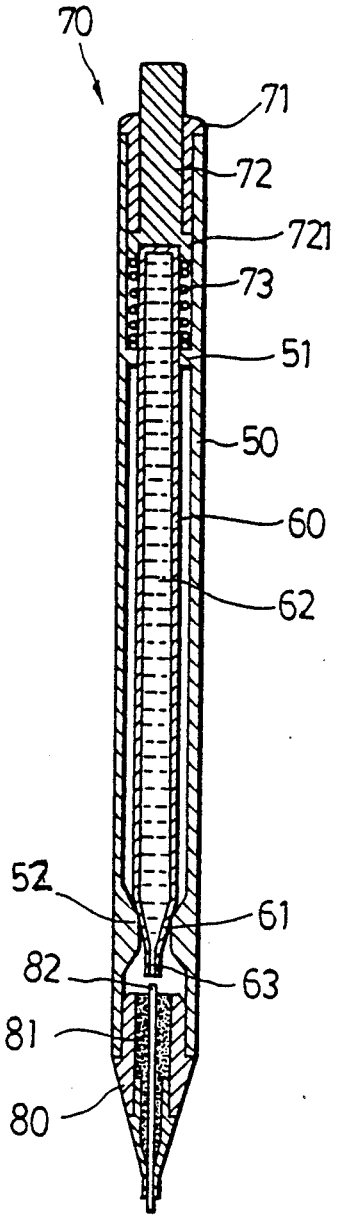
FIG. 3 is a sectional view of the embodiment of FIG. 2.
Figure 4:
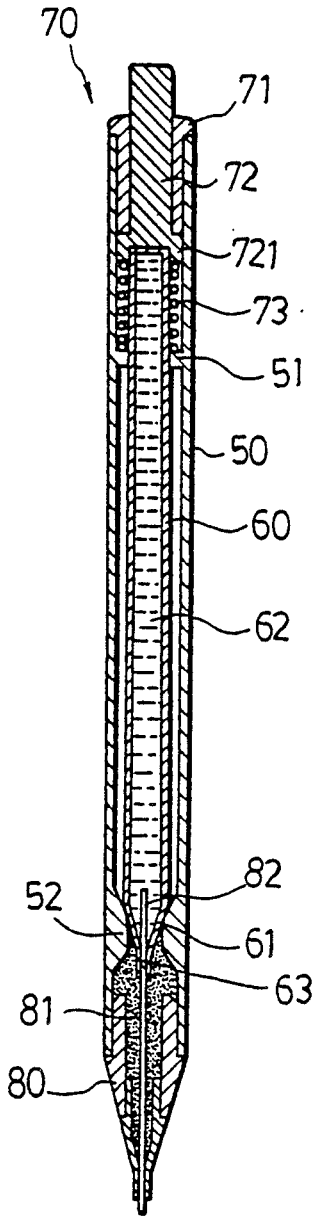
FIG. 4 is a second preferred embodiment according to this invention.

Referring to FIG. 3, the preferred embodiment of FIG. 2 is shown in its assembled form. Ink 62 in the ink tube 60 is collected at the open end 61 of the same. The open end 61 is firmly held by the stopper means 52 of the pen barrel 50. An opposite end is held finally in place by the annular ring 51 of the pen barrel 40. The biasing means 73, which is a spring member, surrounds the portion of the ink tube 60 which projects above the annular ring 51. One end of the biasing means 73 is supported by the annular ring 51. The circular base 721 of the pressure post 70 has its peripheral lower edges resting on the opposite end of the biasing means 73. The wall casing 71 is disposed between the pressure post 72 and the pen barrel 50. When the fountain pen head 80 is jointed to the pen barrel 50, the writing core 82 maintains a gap with the ink outlet hole 63.

When using the preferred embodiment, a pressure force is first applied to the pressure post 72. The pressing force exerted is transmitted to the ink tube 60 and to the ink 62 inside the tube. The pressing force enables the stopper means 52 to generate a contracting force on the ink tube to force the ink 62 to drip out of the ink outlet hole 63. The dripping ink is absorbed by the writing core 82 and the ink absorbent member 81. The writing core 82 guides the absorbed ink in a capillary action for eventual writing use.

Because of the small size of the ink outlet hole 63, the adhesion of the ink molecules and the coagulation of the ink itself make it difficult for the ink 62 to pass through the ink outlet hole 63 without the application of external pressure. Furthermore, the air pressure inside the ink tube 60 is in equilibrium with the pressure outside the tube. Thus, no ink 62 drips out of the ink outlet hole 63.

Excess ink absorbed by the writing core 82 permeates the ink absorbent member 81 to ensure that no blotting occurs.

FIG. r is a sectional view of a second preferred embodiment according to this invention. In this embodiment, the writing core 82 extends through the ink outlet hole 63 and is in constant contact with the ink 62 inside the ink tube 60. The ink absorbent member 81 also extends out of the fountain pen head 80 to surround a portion of the open end 61 of the ink tube 60. Since the writing core 82 is continuously fed with ink, it is not necessary to apply pressure frequently to the urging means 70. The continuous feeding of ink 62 to the writing core 82 ensures that a constant capillary flow of ink that will be transferred to the writing surface during use.

The advantages of using the preferred embodiments are as follow:

1. When the first embodiment is in use, pressure is first applied to the urging means 70. The pressure applied is transmitted to the ink tube 60 which response by releasing droplets of ink 62. The ink is absorbed by the writing core 81 and the ink absorbent member 82. When no pressure is applied to the pressure means 70, no ink will drop out of the ink outlet hole 63, thus ensuring no ink is wasted.

2. Only a small portion of the ink 62 contained by the ink tube 60 is exposed to air. Less evaporation of ink occurs, guaranteeing better efficiency in terms of ink usage.

3. The ink tube 60 is replaceable, thus eliminating the tedious and messy process of pouring ink from an ink bottle to replenish the ink supply of an ordinary fountain pen.

4. The size of the ink absorbent member 81 is reduced, guaranteeing faster absorbency of the ink 62. Since the excess ink absorbed by the writing core 82 is absorbed by the ink absorbent member 81, no blotting occurs when using a fountain pen according to this invention.

while the present invention has been described in connection with what is considered the most practical and preferred embodiment, it is understood that the invention is not limited to the disclosed embodiments, but is intended to cover various arrangements included within the spirit and scope of the broadest interpretation so as to encompass all such modifications and equivalent arrangements.

I claim:

1. A fountain pen, comprising:

an ink tube made of a flexible material, said ink tube having a substantially converging end and a small opening at said converging end for releasing ink, and a top end portion opposite from said converging end;

a fountain pen barrel having a hollow space for receiving said ink tube;

a first protrusion from said fountain pen barrel projecting annularly inward and disposed near a first end of said fountain pen barrel, such that said converging end of said ink tube contacts said first protrusion;

means for urging said ink tube in an axial direction towards said first protrusion, said urging means being received by said fountain pen barrel on a second end opposite said first protrusion and retractably contacting said top end portion of said ink tube so that a pressing force applied on said urging means is transmitted to said ink tube, and said axial movement enables said first protrusion to generate a contracting force on said convergent end of said ink tube to increase the releasing pressure of the ink inside said ink tube via the small opening of the ink tube; and a fountain pen head joined to said first end of said pen barrel, said fountain pen head having an axially disposed pith-like writing core which guides the released ink from said ink tube in a capillary action, said pith-like core being axially fixed inside said fountain pen head and having a first end and second end, said first end protruding from the fountain pen head for writing purposes.

2. A fountain pen as claimed in claim 1, further comprising an ink absorbent member which surrounds said pith-like core for absorbing excess ink released by said ink tube.

3. A fountain pen as claimed in claim 1, wherein:

said fountain pen barrel further comprises a second inwardly projecting annular protrusion disposed near the second end of said fountain pen barrel, said top end portion of said ink tube protruding through said second protrusion; and said urging means further comprises: a biasing means which surrounds said protruding portion of said ink tube, said biasing means having a first and second end, said first end being supported by said second protrusion; a pressure post having a base at one end, the lower peripheral edge of said base resting on the second end of said biasing means; and a tubular wall casing disposed between said fountain pen barrel and said pressure post.

4. A fountain pen as claimed in claim 2, wherein said pith-like core has a second end projecting through said small opening of said ink tube, whereby the ink inside said ink tube can be released by capillary action without applying a pressing force on said urging means.

5. A fountain pen as claimed in claim 4, wherein said ink absorbent member extends upwards from said fountain pen head and surrounds a portion of said converging end of said ink tube.

6. A fountain pen as claimed in claim 1, wherein said pith-like core is axially aligned with said small opening of said ink tube, said second end of said pith-like core being separated from said small opening with a gap, such that the ink inside ink tube can be released by droplets only when said pressing force is applied on said urging means.

7. A fountain pen, comprising:

an ink tube made of a flexible material, said ink tube having an end converging to a small opening for releasing ink, and a top end portion opposite from said bottom end;

a fountain pen barrel having first and second open ends, and a hollow space for receiving said ink tube;

a first protrusion projecting annularly inward from said fountain pen barrel disposed near said first end of the fountain pen barrel, said top end portion of the ink tube protruding through said first protrusion;

a second protrusion projecting annularly inward from said fountain pen barrel and disposed near said second end of the fountain pen barrel, such that said converging end of the ink tube contacts said second protrusion;

means for urging said ink tube in an axial direction towards said second protrusion, said urging means being received by said fountain pen barrel on said first end and retractably contacting said top end portion of the ink tube so that a pressing force applied on said urging means is transmitted to said ink tube, and said axial movement enables said second protrusion to generate a contracting force on said converging end of the ink tube to increase the releasing pressure of the ink inside said ink tube via said small opening of the ink tube;

a spring member of said urging means which surrounds the portion of said ink tube protruding through said first protrusion, said spring member having a first and second end, said first end being supported by said first protrusion;

a pressure post component of said urging means having two ends and a base at one end, the lower peripheral edge of said base resting on the second end of said spring member;

a tubular wall casing component of said urging means disposed between said fountain pen barrel and said pressure post;

a fountain pen head joined to said second end of said pen barrel, said fountain pen head having an axially disposed pith-like writing core which guides the released ink from said ink tube in a capillary action, said pith-like core having a first end and second end and being axially fixed inside said fountain pen head and axially aligned with said small opening of said ink tube, said first end of said pith-like core protruding from the fountain pen head for writing purposes, and said second end of said pith-like core extending from the fountain pen head toward said ink tube and being separated from said small opening of the ink tube by a gap, such that the ink inside said ink tube can be released by droplets only when said pressing force is applied on said urging means;

an ink absorbent member which surrounds a portion of the second end of said pith-like core for absorbing excess ink released by said ink tube.

* * * * *